US008506733B2

(12) United States Patent
Enami et al.

(10) Patent No.: US 8,506,733 B2
(45) Date of Patent: Aug. 13, 2013

(54) $AL_2CA$-CONTAINING MAGNESIUM-BASED COMPOSITE MATERIAL

(75) Inventors: Keitaro Enami, Tokyo (JP); Shoji Ono, Shinagawa-ku (JP); Masaki Ohara, Tokyo (JP); Takanori Igarashi, Tokyo (JP)

(73) Assignee: Topy Kogyo Kabusikikaisya, Shinagawa-ku, Tokyo (JP)

( * ) Notice: Subject to any disclaimer, the term of this patent is extended or adjusted under 35 U.S.C. 154(b) by 501 days.

(21) Appl. No.: 12/921,608

(22) PCT Filed: Mar. 11, 2009

(86) PCT No.: PCT/JP2009/054677

§ 371 (c)(1), (2), (4) Date: Sep. 9, 2010

(87) PCT Pub. No.: WO2009/113581

PCT Pub. Date: Sep. 17, 2009

(65) Prior Publication Data

US 2011/0033333 A1 Feb. 10, 2011

(30) Foreign Application Priority Data

Mar. 11, 2008 (JP) ..... 2008-061343
Jul. 18, 2008 (JP) ..... 2008-186964

(51) Int. Cl.
*C22F 1/06* (2006.01)
*B22F 3/24* (2006.01)

(52) U.S. Cl.
USPC ..... 148/666; 148/667; 419/66; 419/28; 419/67

(58) Field of Classification Search
USPC ..... 148/666, 667; 419/66, 67, 28
See application file for complete search history.

(56) References Cited

U.S. PATENT DOCUMENTS

| | | | |
|---|---|---|---|
| 4,615,733 | A | 10/1986 | Kubo et al. |
| 2007/0258845 | A1 | 11/2007 | Kondoh |
| 2010/0226812 | A1 | 9/2010 | Kondoh |

FOREIGN PATENT DOCUMENTS

| | | |
|---|---|---|
| JP | 61-99655 | 5/1986 |
| JP | 2006-002184 | 1/2006 |
| JP | 2007-51305 | 3/2007 |

OTHER PUBLICATIONS

Patent Abstract of Japan—2007-051305, published Mar. 1, 200 (Topy Ind. Ltd.).

*Primary Examiner* — Roy King
*Assistant Examiner* — Janelle Morillo
(74) *Attorney, Agent, or Firm* — Rankin, Hill & Clark LLP

(57) ABSTRACT

The present invention provides a magnesium-based composite material that can achieve excellent performance such as high tensile strength not only at ordinary temperature but also at high temperature. The magnesium-based composite material of the present invention is $Al_2Ca$-containing magnesium-based composite material, wherein said composite material is obtained by a solid-phase reaction of an aluminum-containing magnesium alloy and an additive, said additive being calcium oxide, and said composite material contains $Al_2Ca$ formed in the solid-phase reaction. In the magnesium-based composite material, CaO, in combination with $Al_2Ca$, can be dispersed.

24 Claims, 9 Drawing Sheets

$AL_2CA$-CONTAINING MAGNESIUM-BASED COMPOSITE MATERIAL

RELATED APPLICATIONS

This application claims the priority of Japanese Patent Applications No. 2008-61343 filed on Mar. 11, 2008 and No. 2008-186964 filed on Jul. 18, 2008, which are incorporated herein by reference.

FIELD OF THE INVENTION

The present invention relates to a magnesium-based composite material in which fine $Al_2Ca$ formed by a solid-phase reaction is dispersed, and in particular, relates to a magnesium-based composite material that can achieve excellent performance such as high tensile strength not only at ordinary temperature but also at high temperature.

BACKGROUND OF THE INVENTION

The specific gravity of magnesium is 1.74 and it is very light. In addition, the specific strength and specific stiffness are better than those of aluminum and steel. Thus, the application as structural components for automobiles, home electric appliances, etc. is increasing. However, the strength characteristics and heat resistance have not been satisfactory. Thus, in the case that a magnesium alloy is used as structural material such as engine parts that are susceptible to heat, an improvement has been desired.

Patent Literature 1, for example, describes a high-toughness magnesium-based alloy in which 1 to 8% rare earth element and 1 to 6% calcium, on a weight basis, are contained and the maximum crystal grain size of magnesium that constitutes the matrix is 30 μm or less. This magnesium-based alloy is produced in the following way.

(1) A magnesium-based alloy ingot containing 1 to 8% rare earth element and 1 to 6% calcium on a weight basis is prepared by a casting method, and raw material powder is obtained, for example, by cutting work of the ingot.

(2) To the raw material powder, a strong processing strain is applied by repeated plastic working at 100 to 300° C. (for example, the compression and denting are alternately repeated to the powder filled in a die). Thus, the raw material powder is mechanically ground, and the magnesium crystal grains of the matrix is refined in grain size. Simultaneously, an acicular intermetallic compound that has formed in the ingot by casting is also finely ground and dispersed inside the magnesium crystal grains.

(3) After the grain refinement treatment by plastic working, as described above, a powder solidified body is prepared by compression molding.

(4) The powder solidified body is heated up to 300 to 520° C. and then immediately extruded to obtain a rod-shaped material of the desired magnesium-based alloy.

However, such a method is time-consuming and very expensive because an ingot of the desired alloy composition is casted and then powdered to obtain raw material powder. In addition, there have been problems in that the casting method for the preparation of a good ingot with a uniform alloy composition is difficult and the range of elemental composition to achieve a uniform alloy composition is limited.

Patent Literature 1 describes that the intermetallic compound $Al_2Ca$ excellent in thermal stability is formed between Ca and Al during casting, and refined in grain size and dispersed in the matrix as described above, which improves the heat resistance of the magnesium alloy. For example, Patent Literature 1 describes the tensile strength at 150° C.

However, the tensile strength at 150° C. is less than 150 MPa in Patent Literature 1, and the tensile strength at a higher temperature is also not satisfactory. Patent Literature 1 also describes that if the amount of a rare earth element and the amount of calcium exceed the suitable range described above, the toughness and the tensile strength decrease. Thus, there is a limitation in the improvement of the effect by the increase in the rare earth element and calcium.

As described above, a fully satisfactory alloy has not been obtained even in Patent Literature 1, wherein a magnesium alloy containing an intermetallic compound, which was formed by a melting method such as casting, are extruded after grain size refinement.

On the other hand, Patent Literature 2 describes the improvement in heat resistance using $SiO_2$, as an additive, and forming the intermetallic compound $Mg_2Si$ by a mechanical solid-phase reaction. Specifically, the $SiO_2$ powder, used as the additive, is mixed with magnesium alloy chips, refined in grain size and dispersed while maintaining the solid phase state. Then extrusion is carried out to obtain a magnesium-based composite material in which the intermetallic compound $Mg_2Si$ is finely dispersed on the boundary of the size-refined crystal grains of the magnesium alloy. In this method, unlike an alloy produced by a melting method, the dispersed compound is not in the crystal grain of the magnesium alloy, but it is on the crystal grain boundary.

However, the strength at high temperature was not quite satisfactory even when $SiO_2$ powder was used.

Patent Literature 1: Japanese Unexamined Patent Publication No. 2006-2184

Patent Literature 2: Japanese Unexamined Patent Publication No. 2007-51305

DISCLOSURE OF THE INVENTION

Problem to be Solved by the Invention

The present invention was made in view of the above-described problems of the background art, and the object is to provide a magnesium-based composite material that can achieve excellent performance such as high tensile strength not only at ordinary temperature but also at high temperature.

Means to Solve the Problem

In order to achieve the above-described object, the present inventors have diligently studied and have found the following. When a mixture of calcium oxide, which is the additive, with an aluminum-containing magnesium alloy is subjected to mechanically grain-size refining treatment while maintaining the solid phase state and then heated to a specified temperature range, a solid-phase reaction takes place. As a result, a magnesium-based composite material, in which the particles of the reaction product $Al_2Ca$ is finely dispersed in the structure of the magnesium alloy of which crystal grains are refined, can be obtained. This magnesium-based composite material is excellent not only in the strength at ordinary temperature but also in the strength at high temperature. In addition, the present inventors have also found that plastic working, such as extrusion, during heating or after heating to a specified temperature range provides a magnesium-based composite material with a high strength at both ordinary temperature and high temperature more stably in quality.

As described in Patent Literature 2, the formation of $Mg_2Si$ in the solid-phase reaction by the use of the additive $SiO_2$ is possible because of the reducing action of Mg against Si. That is, in the Ellingham diagram, which shows a relationship between the standard free energy of oxide formation AG and the temperature, the line of $SiO_2$ is above the line of MgO in the wide temperature range from the ordinary temperature to 2,500° C. Thus, the standard free energy of $SiO_2$ formation is larger than that MgO formation (refer to "Metal Data Book" edited by the Japan Institute of Metals, Revised 2nd Edition, p 90, 1984). Therefore, the reduction of $SiO_2$ with Mg is an exothermic reaction, which proceeds spontaneously to form the intermetallic compound $Mg_2Si$.

On the other hand, when an oxide (for example CaO) having a smaller standard free energy of formation than that of MgO is used as the additive, the formation of an intermetallic compound is theoretically difficult because the reduction of the oxide with Mg is an endothermic reaction.

However, it was surprisingly found that, as a result of the investigation by the present inventors, when CaO was used as the additive to an Al-containing magnesium alloy, the intermetallic compound $Al_2Ca$ was formed by the reduction of CaO.

It is known that $Al_2Ca$ is excellent in thermal stability; however, it is not described in the above-described Patent Literature 2 that $Al_2Ca$ is formed in the magnesium alloy by the solid-phase method using calcium oxide as the additive. It is also not described that a magnesium-based composite material having high-strength not only at ordinary temperature but also at high temperature, such as 250° C., can be obtained. This is new information discovered, for the first time, by the present inventors. The present invention was completed based on this new information.

That is, the present invention provides an $Al_2Ca$-containing magnesium-based composite material, wherein said composite material is obtained by a solid-phase reaction of an aluminum-containing magnesium alloy and an additive, said additive being calcium oxide, and said composite material contains $Al_2Ca$ formed in the solid-phase reaction.

In the present invention, the aluminum-containing magnesium alloy can be a magnesium alloy containing alloyed aluminum and/or mixed aluminum.

In addition, the present invention provides the $Al_2Ca$-containing magnesium-based composite material, wherein CaO, in combination with $Al_2Ca$, is dispersed in the magnesium-based composite material.

In addition, the present invention provides the $Al_2Ca$-containing magnesium-based composite material, wherein the composite material is obtained by mechanically refining, in grain size, a mixture of the aluminum-containing magnesium alloy and the additive while maintaining a solid phase state to prepare a grain-refined mixture, and by carrying out a thermochemical reaction, at less than the melting point, of the grain-refined mixture or its green compact.

In addition, the present invention provides the $Al_2Ca$-containing magnesium-based composite material, wherein the $Al_2Ca$ is formed by the thermochemical reaction, by heating to 350 to 550° C., of the grain-refined mixture or its green compact.

In addition, the present invention provides the $Al_2Ca$-containing magnesium-based composite material, wherein the thermochemical reaction is sintering.

In addition, the present invention provides the $Al_2Ca$-containing magnesium-based composite material, wherein plastic working is carried out after and/or during the thermochemical reaction.

In addition, the present invention provides the $Al_2Ca$-containing magnesium-based composite material, wherein the composite metal is obtained by mechanically refining, in grain size, the mixture of the aluminum-containing magnesium alloy and the additive while maintaining the solid phase state to prepare the grain-refined mixture, and by carrying out the plastic working, at less than the melting point, of the grain-refined mixture or its green compact.

In addition, the present invention provides the $Al_2Ca$-containing magnesium-based composite material, wherein the plastic working is extrusion.

In addition, the present invention provides the $Al_2Ca$-containing magnesium-based composite material, wherein the extrusion temperature is 350 to 550° C.

In addition, the present invention provides any of the $Al_2Ca$-containing magnesium-based composite materials, wherein the amount of the additive in the mixture of the aluminum-containing magnesium alloy and the additive, which are to be subjected to the solid-phase reaction, is 1 to 20 vol %.

In addition, the present invention provides any of the $Al_2Ca$-containing magnesium-based composite materials, wherein the amount of the additive is adjusted so that the mole ratio of Ca/Al in the mixture of the aluminum-containing magnesium alloy and the additive, which are to be subjected to the solid-phase reaction, is 0.5 or higher.

In addition, the present invention provides any of the $Al_2Ca$-containing magnesium-based composite materials, wherein the maximum size of dispersed $Al_2Ca$ particles is 5 μm or less.

In addition, the present invention provides any of the $Al_2Ca$-containing magnesium-based composite materials, wherein the maximum size of dispersed CaO particles is 5 μm or less.

In addition, the present invention provides any of the $Al_2Ca$-containing magnesium-based composite materials, wherein the maximum size of the magnesium alloy crystal grain is 20 μm or less.

In addition, the present invention provides any of the $Al_2Ca$-containing magnesium-based composite materials, wherein $Al_{12}Mg_{17}$ is not contained therein.

In addition, the present invention provides any of the $Al_2Ca$-containing magnesium-based composite materials, wherein the composite metal has the tensile strength of 400 MPa or higher at 20° C. and the tensile strength of 100 MPa or higher at 250° C.

In addition, the present invention provides a material for thermochemical reaction or plastic working, wherein the material is a grain-refined mixture obtained by mechanically refining, in grain size, a mixture of an aluminum-containing magnesium alloy and an additive while maintaining a solid phase state, or its green compact, said additive being calcium oxide, and the material forms $Al_2Ca$ by heating at less than the melting point.

In addition, the present invention provides the material for thermochemical reaction or plastic working, wherein the heating temperature is 350 to 550° C.

In addition, the present invention provides any of the materials for thermochemical reaction or plastic working, wherein the amount of the additive in the mixture of the aluminum-containing magnesium alloy and the additive, which are to be refined in grain size, is 1 to 20 vol %.

In addition, the present invention provides any of the materials for thermochemical reaction or plastic working, wherein the amount of the additive is adjusted so that the mole ratio of Ca/Al in the mixture of the aluminum-containing magnesium alloy and the additive, which are to be refined in grain size, is 0.5 or higher.

In addition, the present invention provides any of the materials for thermochemical reaction, wherein the material is for sintering.

In addition, the present invention provides any of the materials for plastic working, wherein the material is for extrusion.

Effect of the Invention

In the magnesium-based composite material of the present invention, fine $Al_2Ca$ particles, which are formed by a solid-phase reaction, are dispersed in the structure of magnesium alloy of which crystal grains are refined. By these dispersed particles, not only the strength characteristics at ordinary temperature but also that at high temperature are markedly improved. In addition, the strength characteristics are further improved by the dispersion of fine CaO particles in combination with $Al_2Ca$ particles. The presence of CaO particles also contributes to wear resistance.

The magnesium-based composite material of the present invention can be produced from relatively inexpensive raw material, without melting, by a solid-phase reaction. Therefore, it is simple and economical compared with a magnesium-based composite material that is obtained by a melting method such as casting, and the compositional freedom is also high.

In addition, the grain-refined mixture obtained by the grain size refinement of the mixture of the Al-containing magnesium alloy and the additive or its green compact can be used as a material for production of a high-strength $Al_2Ca$-containing magnesium-based composite material, for example, as a material for thermochemical reaction such as sintering and as a material for plastic working such as extrusion.

BEST MODE FOR CARRYING OUT THE INVENTION

Figure 1:
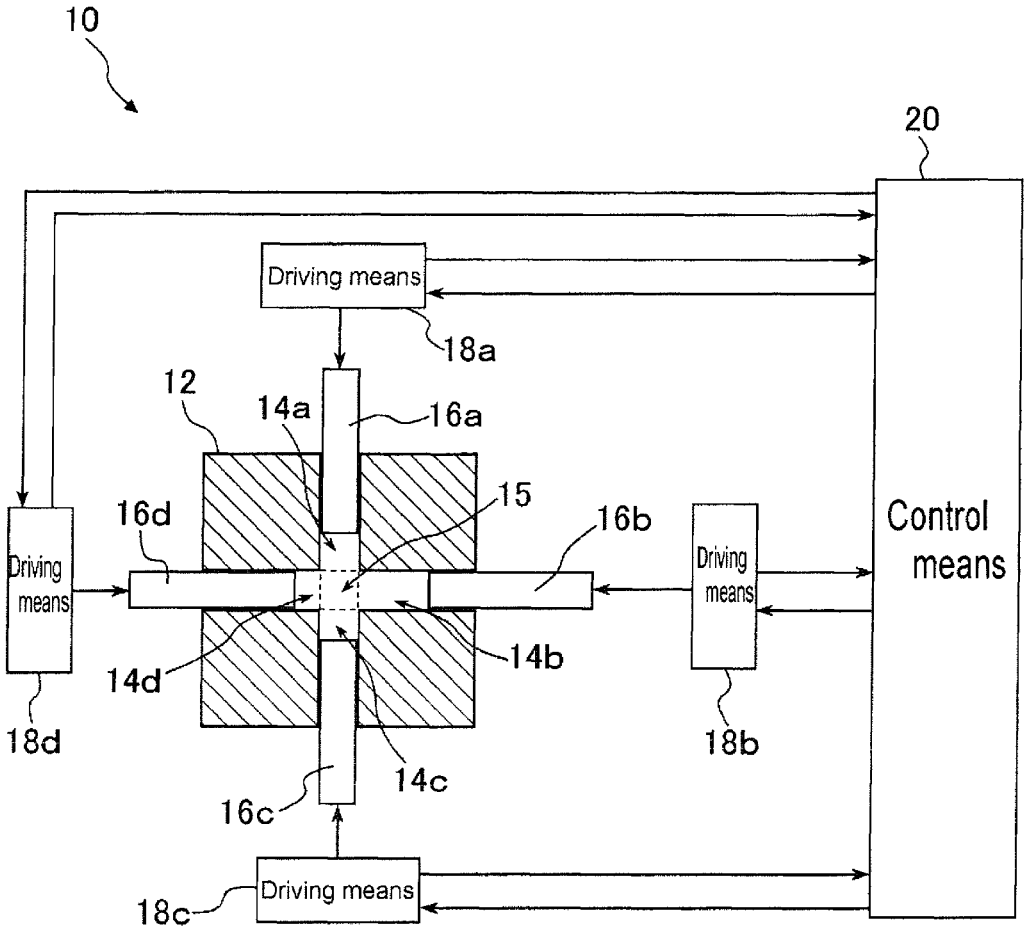
FIG. 1 is a schematic diagram that illustrates one example of grain size refinement equipment used in the production of $Al_2Ca$-containing magnesium-based composite material of the present invention.

The magnesium-based composite material of the present invention is a magnesium-based composite material, in which fine $Al_2Ca$ particles are dispersed in the structure of magnesium alloy with fine crystal grains. This is obtained by a solid-phase reaction of an Al-containing magnesium alloy and, as the additive, calcium oxide.

Typically, it is obtained by a solid-phase reaction method in which a mixture of an Al-containing magnesium alloy and the additive is mechanically refined in grain size while maintaining the solid phase state, and then a thermochemical reaction is carried out at less than the melting point, preferably at 350 to 550° C. From the standpoint of strength etc., it is preferable to carry out plastic working during the thermochemical reaction and/or after the thermochemical reaction. The plastic working includes one or more publicly known processings such as extrusion, forging, rolling, drawing, and pressing, and a preferable example is extrusion.

Al-Containing Magnesium Alloy

As the Al-containing magnesium alloy used as the starting raw material in the present invention, a magnesium alloy in which Al is alloyed with the main component magnesium (Mg—Al alloys) can be used. Generally well-known alloys are Mg—Al—Mn alloys (AM series) and Mg—Al—Zn alloys (AZ series).

Al may be simply mixed in the magnesium alloy without being alloyed. For example, a simple mixture of Al and one or more selected from the magnesium alloys in which Al is not alloyed (can be pure magnesium) and the magnesium alloys in which Al is alloyed can be used as the Al-containing magnesium alloy of the present invention. When Al is mixed, an alloy in which aluminum is the main component (aluminum alloy), as well as pure aluminum, can be used as the Al source so far as there is no specific problem.

The content of Al is suitably adjusted in accordance with the purpose. Normally, the content of Al in an Al-containing magnesium alloy is 1 to 20 mass %, preferably 2 to 15 mass %, and more preferably 3 to 10 mass %.

In the Al-containing magnesium alloy, other elements other than Mg and Al, such as Zn, Mn, Zr, Li, Ag, and RE (RE: rare earth elements), may be contained. The sum of other elements other than Mg and Al in the Al-containing magnesium alloy is normally 10 mass % or less, typically 0.1 to 10 mass %, and preferably 0.5 to 5 mass %.

The form and size of the Al-containing magnesium alloy are not limited in particular, and the examples include powder form, granular form, block form, and chip form. For example, chips or granules with the average particle size of about 0.5 mm to 5 mm are conveniently used.

Additive

As the additive in the present invention, calcium oxide is used.

The form and size of the additive are not limited in particular. For example, the powder with the average particle size of 5 μm to 100 μm and more preferably the powder with the average particle size of 10 μm to 50 μm are conveniently used.

The amount of the additive is not limited so far as the effect of the present invention can be obtained. Normally, the effect can be achieved if the percentage of the additive in the mixture of the entire components, which are to be refined in grain size, is 1 vol % or higher. The percentage is preferably 5 vol % or higher, and more preferably 7 vol % or higher. If the amount of the additive is too small, the effect will be low. On the other hand, even if an excess amount is blended, an increase in the effect corresponding to the increased amount cannot be expected. In addition, other properties may be adversely affected. Thus, the amount is preferably 20 vol % or less, and more preferably 15 vol % or less.

Here, the amount of an additive means the percentage (vol %) of the additive in the mixture to be refined in grain size when the mixture is regarded as one voidless solid consisting of the entire components. Thus, it is calculated by the following equation from the true densities and the blending masses of an Al-containing magnesium alloy and the additive.

$$\text{Additive } (vol\ \%) = \frac{(\text{Additive mass/Additive density}) \times 100}{(\text{Additive mass/Additive density}) + (\text{Mg alloy mass/Mg alloy density})}$$

For example, in the mixture of 90 parts by mass of AM60B alloy (true density: 1.79 g/cm$^3$) and 10 parts by mass of CaO (true density: 3.35 g/cm$^3$, about 7.1 parts by mass of Ca), CaO in this mixture is about 5.6 vol %.

In addition, it is preferable to use the additive, from the standpoint of reactivity etc., so that the mole ratio of Ca/Al, in the mixture of an Al-containing magnesium alloy and the additive, is 0.5 or higher, more preferably 0.8 or higher, and especially preferably 1 or higher.

In the present invention, so far as the effect of the present invention is not undermined, other compounds can be supplementarily added as necessary. As such secondary additives, for example, one or more selected from rare earth metals; oxide, carbide, silicide, and carbonate of Sr or Ba; and carbide, silicide, and carbonate of Ca can be listed. Examples of rare earth metals include Sc, Y, La, Ce, Pr, Nd, Sm, Gd, Tb, Yb, Lu, and misch metals containing these elements.

If an intermetallic compound (for example, La—Mg compounds and Al—Y compounds) excellent in thermal stability is formed by using the above-described secondary additive in combination with the additive of the present invention and by reacting at least part of the secondary additive with the metal components of the Al-containing magnesium alloy, it is possible to further improve the strength characteristics and heat resistance of the Al-containing magnesium-based composite material. The formation of the intermetallic compound can be confirmed, for example, by the appearance, in the X-ray diffraction pattern, of a peak other than that of $Al_2Ca$ and different from any peaks of the Al-containing magnesium alloy, the additive, and the secondary additive, which are starting raw materials. If the peak pattern of the intermetallic compound is known, the intermetallic compound can be identified by referencing to them.

The kinds and the amounts of such secondary additives can be set according to the necessary material characteristics for the mixture to be refined in grain size. Even if an excess amount is blended, an increase in the effect corresponding to the increased amount cannot be expected. In addition, other properties may be adversely affected. Thus, the amount is preferably 20 vol % or less, and more preferably 15 vol % or less.

Other publicly known reinforcing materials for magnesium alloys can also be added.

Production Method

The preferable production method of the magnesium-based composite material of the present invention will be explained hereinafter with reference to representative examples. However, the present invention is not limited by these examples.

Figure 4:
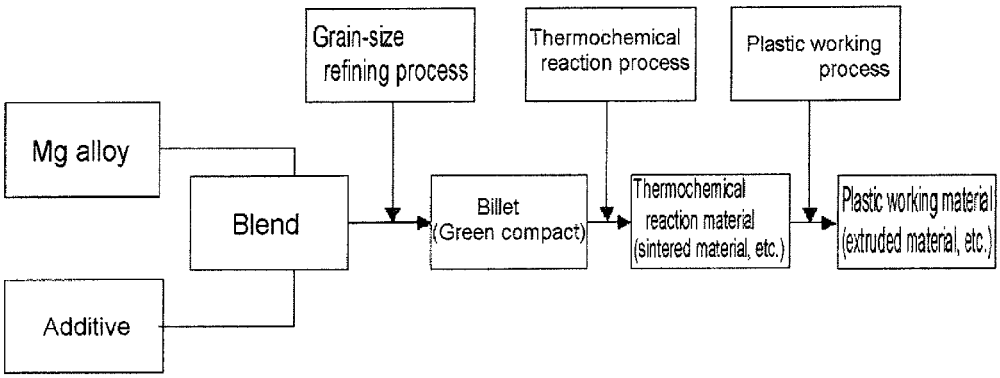
FIG. 4 is an explanatory diagram that illustrates one example of the production process of the $Al_2Ca$-containing magnesium-based composite material of the present invention.

The magnesium-based composite material of the present invention is preferably produced, as shown in the schematic figure (FIG. 4), by the production method comprising:

(a) grain-size refining process, (b) thermochemical reaction process, and (c) plastic working process.

(a) Grain-Size Refining Process:

In the grain-size refining process of the mixture of an Al-containing magnesium alloy and the additive, the Mg alloy crystal grains are refined in grain size while the mixture is mechanically ground. The grain size refinement method is not limited in particular so far as the method can refine the size of both the Mg alloy crystal grains and the additive particles by providing a strong strain treatment to the components of the mixture, and any publicly known method can be adopted. In order to promote the later formation of $Al_2Ca$, to suppress the coarsening of crystal grains, and to achieve a high strength in the wide range from room temperature to high temperature, it is desirable that the size of both the Mg alloy crystal grains and the additive are sufficiently and uniformly refined.

As a preferable method of grain size refinement, the method of compressing and crushing, in particular, the method of compressing and crushing with a shear force and/or friction force can be adopted.

At the end of the grain-size refining process, it is preferable, from the standpoint of handling and reactivity, to form a green compact by compression molding.

For example, the following method is preferable: a mixture of Al-containing magnesium alloy chips or granules and the additive powder are accommodated in a die having plural, straight, mutually-crossing, and connected compacting holes; in this state, with the forward movement and backward movement of pressing members, which are inserted in the compacting holes, the mixture is compressed in one compacting hole and then further sent to another compacting hole while the compressed mixture is being crushed; these compressing and crushing are repeated to refine the mixture; and at the end, the mixture is compressed to prepare a green compact.

Such a grain-size refining process is very doable at ambient temperature without special heating.

Hereinafter, a preferred embodiment will be further explained.

In the grain-size refining process of the present embodiment, it is preferable to refine, with the use of the equipment shown in FIG. 1, a mixture of Al-containing magnesium alloy chips and the additive powder and at the end, to obtain a green compact by compression molding. With the equipment in FIG. 1, the mixture receives a large shear force and friction force in the almost entire region when the mixture passes through the crossing section. Thus, the grain size refinement and the dispersion of the Mg alloy crystal grains and the additive are carried out uniformly and efficiently.

Equipment 10, shown in FIG. 1, has a cuboid-shaped die 12. In the die 12, four straight compacting holes 14*a*, 14*b*, 14*c*, and 14*d* are formed. The respective compacting holes 14*a* to 14*d* have an identical cross-sectional shape (preferably a circular cross-section with an identical diameter) and radially connected at the crossing section 15 located at the center of the die 12. In addition, the respective compacting holes 14*a* to 14*d* are arranged, in this order, circumferentially at intervals of 90° on the same plane (on the vertical plane or horizontal plane).

In the compacting holes 14*a* to 14*d*, the pressing members 16*a* to 16*d* (the first to the fourth pressing members), which have an approximately equal cross-sectional shape to that of the respective compacting holes 14*a* to 14*d*, are slidably inserted, and they can move forward and backward along the respective compacting holes. The forward movement and backward movement of these pressing members 16*a* to 16*d* are carried out by the driving means 18*a* to 18*d*. The driving means consists of a hydraulic cylinder etc. By the control means 20, the control of respective driving means are carried out based on the pressure information and the information from position sensors, etc. of the respective driving means 18*a* to 18*d*.

Figure 2:
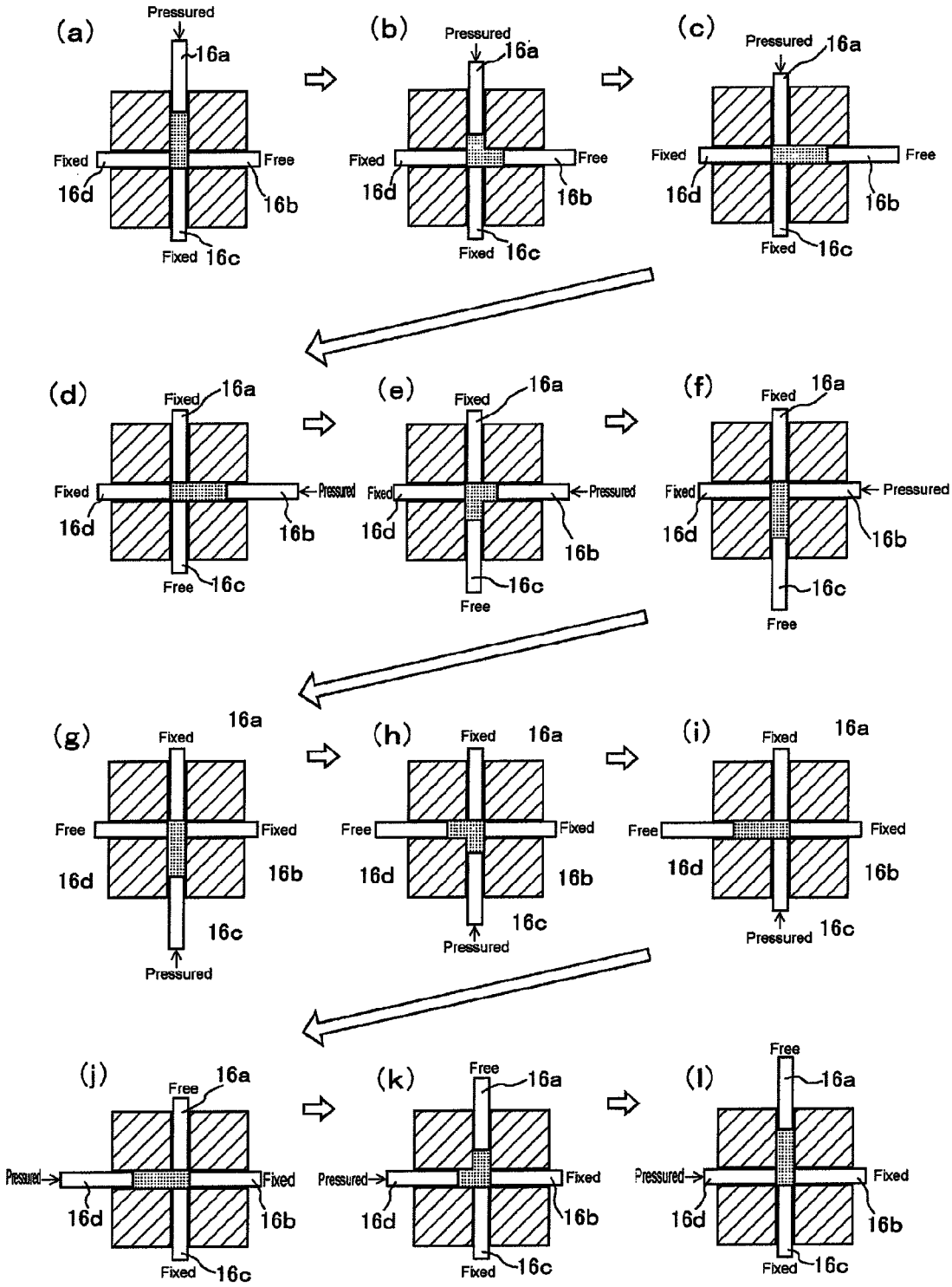
FIG. 2 is an explanatory diagram that illustrates one example of grain-size refining process in the production of $Al_2Ca$-containing magnesium-based composite material of the present invention.

At first, as shown in FIG. 2(*a*), a mixture is loaded into the compacting hole 14*a* in the state that the pressing member 16*a* is pulled out. On this occasion, the end of the forward movement side (direction facing the inside of the die) of the respective pressing members 16*b*, 16*c*, and 16*d* is located at the same position as the inner end of the respective compacting holes 14*b*, 14*c*, and 14*d*, which are neighboring the crossing section 15 (hereinafter, this position is called as the advanced position). The respective pressing members 16*b*, 16*c*, and 16*d* are restrained by the driving means 18*b*, 18*c*, and 18*d* so that the backward movement (direction facing the outside of the die) is not possible, and they are virtually in a fixed state. Then, the pressing member 16*a* is inserted into the compacting hole 14*a* and the following sequence control is started.

Initially, the compressing process is carried out with the pressing member 16*a*. The pressing member 16*a* is pushed into the compacting hole 14*a* by the driving means 18*a*. Because other pressing members 16*b* to 16*d* are fixed, the mixture can not move to the compacting holes 14*b* to 14*d* and compressed in the compacting hole 14*a*, forming a cylindrical mass. This mass has a specified strength but relatively brittle. This compressing is held for a short time, for example, for about 2 seconds under a specified pressure.

Subsequently, the crushing process is carried out with the pressing member 16*a*. The pressing member 16*a* is pushed in with a higher pressure by the driving means 18*a*, and simultaneously, the backward movement of the pressing member 16*b* is enabled by the driving means 18*b*. Then, as shown in FIG. 2(*b*) and FIG. 2(*c*), the pressing member 16*a* is pushed in to the advanced position, and the mixture flows from the compacting hole 14*a*, through the crossing section 15, to the compacting hole 14*b* and crushed in this process. The pressing member 16*b* moves backward by being pushed by the mixture that flowed in. When the front end of the pressing member 16*a* reaches the inner end of compacting hole 14*a*, the crushing process is completed.

Then, a similar compressing process to the above is carried out with the pressing member 16*b*. That is, as shown in FIG. 2(*d*), the pressing members 16*a*, 16*c*, and 16*d* are fixed at the advanced positions, and the pressing member 16*b* is pushed in by the driving means 18*b*; thus the mixture is compressed.

Subsequently, a similar crushing process to the above is carried out with the pressing member 16*b*. That is, the pressing member 16*c* is set so that the backward movement is possible (free state), and the pressing member 16*b* is pushed in. Then, as shown in FIG. 2(*e*) and FIG. 2(*f*), the pressing member 16*b* is pushed in to the advanced position, and the mixture flows from the compacting hole 14*b*, through the crossing section 15, to the compacting hole 14*c* and crushed in this process. The pressing member 16*c* moves backward by being pushed by the mixture that flowed in.

Similarly, the compressing process is carried out with the pressing member 16*c*. That is, as shown in FIG. 2(*g*), the pressing members 16*a*, 16*b*, and 16*d* are fixed at the advanced positions, and the pressing member 16*c* is pushed into the die 12 by the driving means 18*c*; thus the mixture is compressed.

Subsequently, a similar crushing process to the above is carried out with the pressing member 16*c*. That is, the pressing member 16*d* is set so that the backward movement is possible (free state), and the pressing member 16*c* is pushed in. Then, as shown in FIG. 2(*h*) and FIG. 2(*i*), the pressing member 16*c* is pushed in to the advanced position, and the mixture flows from the compacting hole 14*c*, through the crossing section 15, to the compacting hole 14*d* and crushed in this process. The pressing member 16*d* moves backward by being pushed by the mixture that flowed in.

Similarly, the compressing process is carried out with the pressing member 16*d*. That is, as shown in FIG. 2(*j*), the pressing members 16*a*, 16*b*, and 16*c* are fixed at the advanced positions, and the pressing member 16*d* is pushed into the die 12 by the driving means 18*d*; thus the mixture is compressed.

Subsequently, a similar crushing process to the above is carried out with the pressing member 16*d*. That is, the pressing member 16*a* is set so that the backward movement is possible (free state), and the pressing member 16*d* is pushed in. Then, as shown in FIG. 2(*k*) and FIG. 2(*l*), the pressing member 16*d* is pushed in to the advanced position, the mixture flows from the compacting hole 14*d*, through the crossing section 15, to the compacting hole 14*a* and crushed in this process. The pressing member 16*a* moves backward by being pushed by the mixture that flowed in.

The process shown in FIG. 2(*a*) to FIG. 2(*l*) is repeated an arbitrary number of times to carry out the uniform and sufficient grain size refinement and dispersion. At last, a compressing process is carried out to obtain a green compact.

The pressure applied for the formation of a green compact is not limited in particular. For example, 250 kg/cm$^2$ to 400 kg/cm$^2$ can be applied.

As explained above, the starting raw material mixture is once compressed in a compressing process, and then, crushed in a crushing process. The mixture received a large shearing force and friction force, in the almost entire cross-sectional area, when the mixture passes through the crossing section. Therefore, the grain size refinement and the dispersion of the Mg alloy crystal grains and the additive are carried out uniformly and efficiently.

Figure 3:
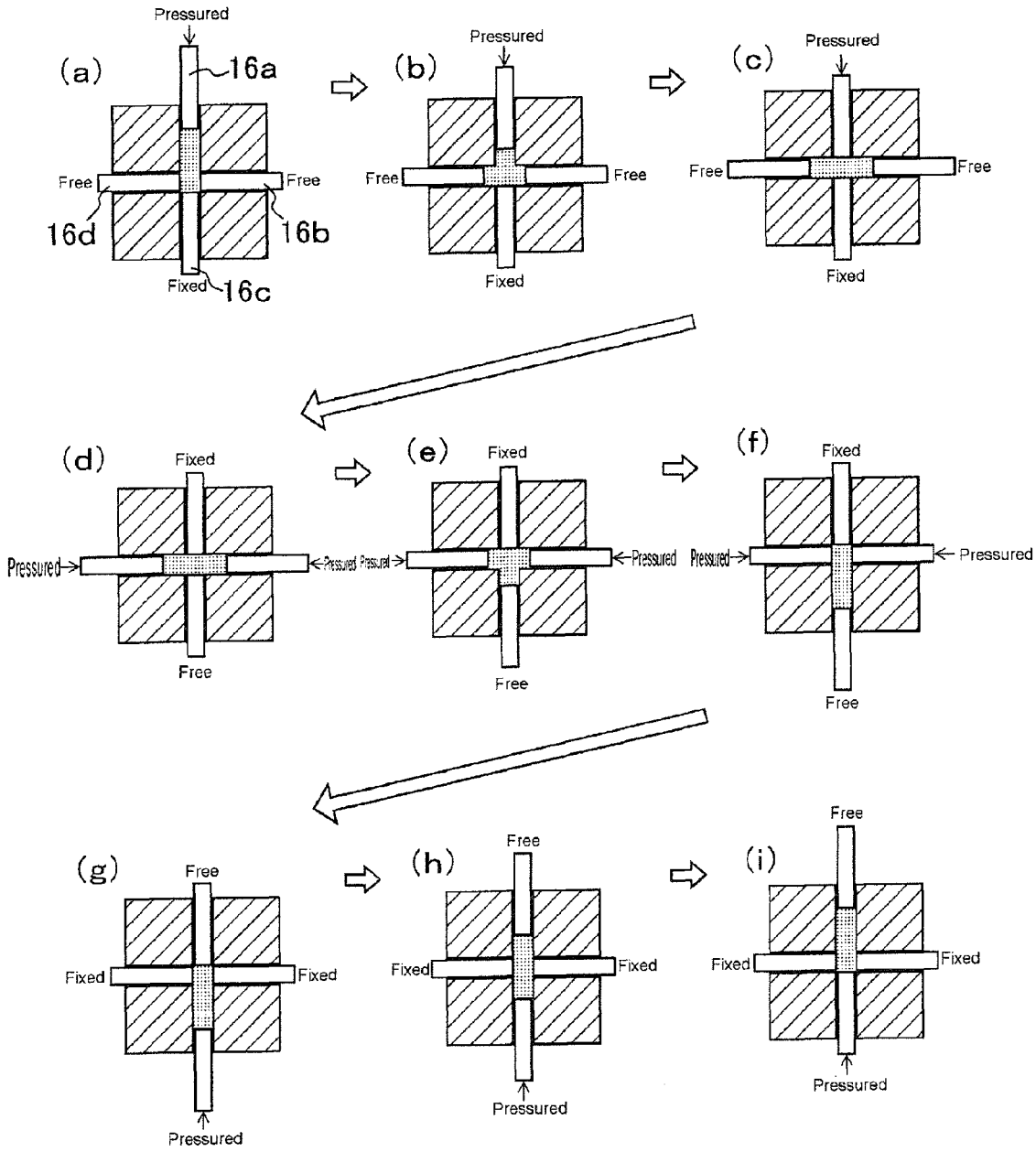
FIG. 3 is an explanatory diagram that illustrates one example of grain-size refining process in the production of $Al_2Ca$-containing magnesium-based composite material of the present invention.

In order to carry out more uniform grain size refinement and the dispersion, it is preferable to carry out an agitation process, as shown in FIG. 3, between the compressing process and the crushing process.

At first, as shown in FIG. 3(*a*), the pressing member 16*c* is fixed at the advanced position, and the pressing members 16*b* and 16*d* are set free so that the backward movement is possible. In this state, if the pressing member 16*a* is pushed in, as shown in FIG. 3(*b*) and FIG. 3(*c*), the mixture flows from the compacting hole 14*a*, through the crossing section 15, into the compacting holes 14*b* and 14*d*. Then, the pressing members 16*b* and 16*d* move backward by being pushed by the mixture.

After the pressing member 16*a* is pushed in to the advanced position, as shown in FIG. 3(*d*), the pressing member 16*a* is fixed, the pressing member 16*c* is set free, and the pressing members 16*b* and 16*d* are pushed in. Then, as shown in FIG. 3(*e*) and FIG. 3(*f*), the mixture in the compacting holes 14*b* and 14*d* flows into the compacting hole 14*c*. On this occasion, the pressing member 14*c* moves backward by being pushed by the mixture.

After the pressing members 16*b* and 16*d* are pushed in to the advanced positions as shown in FIG. 3(*f*), the pressing members 16*b* and 16*d* are fixed, and the pressing member 16*a* is set free as shown in FIG. 3(*g*). Then, as shown in FIG. 3(*h*) and FIG. 3(*i*), the pressing member 16*c* is pushed in to the advanced position. As a result, the mixture moves from the compacting hole 14*c*, through the crossing section 15, to the compacting hole 14*a*, and the pressing member 16*a* moves backward by being pushed by the mixture.

By carrying out such an agitation process between the above-described compressing process and the crushing process, the grain size refinement and the dispersion can be carried out more efficiently.

In the above-described embodiment, the equipment with the configuration in which four compacting holes are installed in the die was shown as an example. However, the equipment is not limited by this example, and the equipment with the configuration in which plural compacting holes, for example, 2 to 6 compacting holes are installed can be used. In addition, the equipment with the configuration in which the die is fixed and a driving means is installed for each press member was explained. However, the equipment with the configuration in which there is only one driving means and the die is rotatable can be used.

As such a grain-size refining process, Japanese Unexamined Patent Publication No. 2005-248325 and the above-described Patent Literature 2, for example, can be referred to.

(b) Thermochemical Reaction Process:

As described above, after the grain refinement treatment of an Al-containing magnesium alloy and the additive, $Al_2Ca$ can be formed by a thermochemical reaction induced by heating at a suitable temperature that is less than the melting point. The heating temperature at which such a thermochemical reaction was induced depended upon the kinds of raw materials etc; however, it was normally 350° C. to 550° C., and 400 to 500° C. was preferable.

Accordingly, it is preferable to form $Al_2Ca$ by heating a grain-refined mixture or its green compact to the above-described temperature range to be reacted thermochemically.

As described above, in the magnesium-based composite material obtained via a grain-size refining process and a thermochemical reaction process, $Al_2Ca$ fine particles are dispersed in the structure of magnesium alloy of which crystal grains are refined. As shown in Examples below, $Al_2Ca$ is not formed in the grain-size refining process but formed in the subsequent thermochemical reaction process. However, if the grain-size refining process is not carried out, $Al_2Ca$ cannot be formed even when the thermochemical reaction process is carried out.

Accordingly, it is considered that a solid-phase reaction is induced by the combined action of the grain-size refining process and the thermochemical reaction process, and the theoretically difficult $Al_2Ca$ formation can progress.

(c) Plastic Working Process:

Subsequently, in order to achieve higher strength of the above obtained magnesium-based composite material, a plastic working is carried out with the use of publicly known equipment. $Al_2Ca$ particles are formed by the heating in the thermochemical reaction process. By further carrying out the plastic working, particles strongly adhere, join, and consolidate to each other. Thus, a high-strength magnesium-based composite material, in which fine $Al_2Ca$ particles are dispersed in the fine magnesium alloy structure, can be obtained.

In the plastic working process, the above-described thermochemical reaction process and the plastic working process can be simultaneously performed by carrying out the plastic working while adding heat.

As the plastic working, for example, the extrusion is preferable. In this case, the extrusion conditions can be suitably set so that the adhesion, join and consolidation of particles can be carried out satisfactorily.

For example, the extrusion ratio is normally 2 or higher, preferably 5 or higher, and more preferably 10 or higher.

As described above, when the extrusion, as a plastic working, and the thermochemical reaction process are simultaneously carried out, the extrusion temperature can be set at less than the melting point. From the standpoint of $Al_2Ca$ formation and extrudability, the extrusion temperature is preferably in the range of 350 to 550° C., and more preferably 400 to 500° C.

The grain-refined mixture or its green compact can be suitably used as a material for a plastic working because a high-strength magnesium-based composite material, in which fine $Al_2Ca$ particles are dispersed in the magnesium alloy of which crystal grains are refined, can be obtained by carrying out the plastic working such as extrusion at a temperature where $Al_2Ca$ can be formed.

In addition, the plastic working can also be carried out after the formation of $Al_2Ca$ by thermally reacting, while maintaining the solid phase state, at least part of the additive by heating the grain-refined mixture or its green compact at a temperature where $Al_2Ca$ can be formed.

Alternatively, the grain-refined mixture or its green compact can be used as a material for thermochemical reaction for the production of $Al_2Ca$-containing magnesium-based composite material by thermochemically reacting while maintaining the solid phase state. For example, when a final product of complicated shape is directly produced or when the plastic workability such as extrudability or the secondary workability of a green compact of a grain-refined mixture is not sufficient, sintering is one of the effective means. The grain-refined mixture of the present invention or its green compact is usable as the material for sintering. Examples of sintering methods include an atmosphere sintering method, hot pressing, HIP (hot isotropic pressing sintering method), PCS (pulse current sintering method), and SPS (spark plasma sintering method). The sintering can be carried out either under pressure or without pressure.

Whether a green compact is used as the material for sintering or powder is used for powder metallurgy can be decided in accordance with application. The powder obtained by pulverizing the grain-refined mixture or its green compact, to 100 μm or less, with a publicly known pulverizer such as a ball mill or by a publicly known method, and further by sieving if necessary, can be used for the powder for sintering.

$Al_2Ca$-Containing Magnesium-Based Composite Material

In the $Al_2Ca$-containing magnesium-based composite material of the present invention, it is preferable, from the standpoint of the strength at ordinary temperature, that the size of the magnesium alloy crystal grains is refined. Specifically, for example, the maximum crystal grain size of the magnesium alloy, determined from a micrograph of the metallic structure, is preferably 20 μm or less, and more preferably 10 μm or less.

When the crystal grains of magnesium alloy are refined in grain size, it is susceptible to grain boundary sliding at high temperature and the strength will decrease. In the present invention, however, fine $Al_2Ca$ particles are dispersed on the crystal grain boundary; therefore, a high strength can be attained even at high temperature.

In the magnesium-based composite material, the maximum particle size of $Al_2Ca$ particles determined from the micrograph of metallic structure is normally 5 μm or less, typically 2 μm or less, and more typically 1 μm or less.

In the magnesium-based composite material of the present invention, it is preferable, from the standpoint of strength etc., that the unreacted CaO fine particles are also dispersed. In this case, the abrasion resistance can be improved by CaO fine particles.

Generally, the heat resistance of a metal oxide is higher than that of the corresponding metal. Therefore, the dispersion of CaO fine particles in the magnesium-based composite material improves the heat resistance such as the tensile strength at high temperature, as well as improves the strength by acting as a resistance against grain boundary sliding. In addition, the dispersion of CaO fine particles contributes to improvement in Young's modulus, 0.2% proof stress, and the hardness. On the other hand, there is a lowering effect on the average linear expansion coefficient.

Furthermore, because of the presence of oxide particles, the deterioration of mechanical properties due to the magnesium alloy crystal grain coarsening by heating is also suppressed.

In the magnesium-based composite material, the maximum particle size of CaO particles determined by the micrograph of metallic structure is normally 5 μm or less, typically 2 μm or less, and more typically 1 μm or less.

In the present invention, for example, a high-strength magnesium-based composite material of which the specific gravity is 1.9 to 2.0 and the tensile strength is 400 MPa or higher at 20° C., 280 Mpa or higher at 150° C., and 100 MPa or higher at 250° C., can be obtained.

Young's modulus of the conventional magnesium alloys at 20° C. is normally about 45 GPa. According to the present invention, the performance of 48 GPa or higher, more typically 50 GPa or higher, and most typically 55 GPa or higher can be obtained.

In the 0.2% proof stress at 20° C., 350 MPa or higher and more typically 400 MPa or higher can be achieved.

The Vickers hardness at 20° C. can be 85 or higher, more typically 100 or higher, and most typically 120 or higher.

On the other hand, the linear expansion coefficient at 20° C. to 200° C. can be about $2\times10^{-5}$/K to $2.6\times10^{-5}$/K; thus the linear expansion coefficient can be lowered from those of the conventional magnesium alloys.

The magnesium-based composite material of the present invention can be produced not by a melting method such as casting, but by a solid-phase method, with the use of commercially available Mg—Al alloys and CaO. Thus, the ingot production of the desired alloy composition and its powdering are not necessary, and there is little restriction in the amount of the additive. In addition, because CaO is inexpensive and light, the application of CaO has a very great industrial merit in cost, light weight properties, etc.

The magnesium-based composite material of the present invention is excellent in strength characteristics, in particular, in the strength at high temperature. Therefore, it can be suitably used in various applications that demand these characteristics. For example, it is applicable, though not limited by these, automobile engine peripheral parts (e.g., a piston, a valve retainer, and a valve lifter) etc.

Because the magnesium-based composite material of the present invention has high heat resistance, its characteristics can be sufficiently exhibited even after further plastic working to from a desired part.

EXAMPL ES

Hereinafter, the present invention will be explained in further detail with reference to specific examples. However, the present invention is not limited by these examples. Test methods, materials, and reagents used in the present invention are as follows.

(0.2% Proof Stress and Tensile Strength)

Based on JIS Z 2201 "Test pieces for tensile test for metallic materials", a test piece with a parallel section diameter of 5 mm and a gage length of 25 mm (in conformity with the JIS No 14A test piece shape) was cut out and used. Based on JIS Z 2241 "Method of tensile test for metallic materials", the tensile test was carried out at room temperature (about 20° C.) and 250° C. As the tensile tester, an Autograph universal testing machine (manufactured by Shimadzu Corporation, tensile maximum load: 100 kN) with a heating oven was used. The test was carried out at a tester stroke rate of 8.4 mm/min (displacement control). The tensile test at 250° C. was carried out after a test piece was chucked to the Autograph universal testing machine and enclosed in a heating oven, a thermocouple was attached with heat-resistant tape to the vicinity of a parallel section of the test piece, and the temperature of the test piece reached 250° C.

The 0.2% proof stress was measured by the offset method stipulated in the above-described tensile test method.

(X-Ray Diffraction Pattern)

X-ray diffraction patterns were collected with a RAD-3B System (Rigaku Corporation) at the angle of 30° to 80°, a sampling width of 0.020°, a scan rate of 1°/min, X-ray source of CuKα, a voltage of 40 KV, and a current value of 30 mA.

(SEM Micrograph)

An SEM micrograph was observed and recorded with a scanning electron microscope ABT-60 (manufactured by TOPCON Corporation).

(AES Image)

AES images were observed and recorded with a scanning Auger spectrometer PHI 700 (manufactured by ULVAC-PHI, Inc.).

(Hardness)

A micro-Vickers hardness tester (manufactured by Shimadzu Corporation, HMV-2000) was used. The hardness at room temperature (about 20° C.) was measured by applying 100 g of indentation load for 6 seconds and measuring the indentation size.

(Linear Expansion Coefficient)

A compressive load method was used. A test piece cut out in a shape of ϕ5×15 mm was used. The elongation with respect to the temperature change was measured with a thermomechanical analyzer (manufactured by Rigaku Corporation, TMA8310) at a temperature increase rate of 5° C./min, in the temperature range from room temperature (about 20° C.) to 355° C., and a compressive load of 98 mN. Then, the linear expansion coefficient at 25° C. was calculated.

(Young's Modulus)

According to JIS Z2280 "Test method for Young's modulus of metallic materials at elevated temperature", Young's modulus at 20° C. was measured by an ultrasonic pulse method. As the testing equipment, a burst wave sonic velocity measuring device (manufactured by RITEC Inc., RAM-5000 model) was used.

(Materials and Reagents)

All Al-containing magnesium alloy chips were manufactured by Nikko Shoji Co., Ltd. (particle size <2.5 mm). Aluminum powder (purity: 99.5%, particle size <0.15 mm) was manufactured by Kojundo Chemical Laboratory Co., Ltd.

Calcium oxide, being the additive, manufactured by Wako Pure Chemical Industries, Ltd. (product number: 036-19655, CaO purity: 98%), and lanthanum oxide manufactured by Kojundo Chemical Laboratory (code number: LAO02PB, purity: 99.99%) were used.

Production Example 1

Production of Magnesium-Based Composite Material

Al-containing magnesium alloy chips and the additive powder were blended to obtain a mixture. The mixture was grain-refined with the equipment shown in the above FIG. 1, to prepare a green compact (billet). As the number of grain refinement treatment, a combination of the grain-size refining process shown in FIG. 2(*a*) to FIG. 2(*l*) and the agitation process shown in FIG. 3(*a*) to FIG. 3(*i*) was counted as four times.

The obtained green compact preheated at 400 to 470° C. was extruded under a condition where the heating temperature of the container and die is 400 to 470° C., the extrusion diameter is 7 mm, and the extrusion ratio is 28, to obtain an extruded material (round bar) of the magnesium-based composite material.

Various magnesium-based composite materials were produced according to the above-described Production Example 1, and tested.

Test Example 1

Effect of Additive

According to Production Example 1, the extruded material (round bar) of magnesium-based composite material was produced by using the ASTM standard AM60B as the Al-containing magnesium alloy.

TABLE 1

| | | Additive | | | Tensile strength (MPa) | | |
|---|---|---|---|---|---|---|---|
| No. | Mg alloy | Type | Added Amount (vol %) | Number of treatment | 20° C. | 250° C. | Specific gravity |
| 1-1 | AM60B | — | 0 | 200 | 345 | 45 | 1.78 |
| 1-2 | AM60B | CaO | 2 | 200 | 384 | 66 | 1.83 |
| 1-3 | AM60B | CaO | 5 | 200 | 420 | 108 | 1.86 |
| 1-4 | AM60B | CaO | 10 | 200 | 478 | 193 | 1.95 |
| 1-5 | AM60B | CaO | 15 | 200 | 515 | 194 | 2.03 |

As seen from Table 1, the tensile strength was improved with the use of CaO as the additive. The tensile strength increased with an increase in the amount of the additive. In particular, the tensile strength at high temperature (250° C.) was markedly improved and when the amount of the additive was 10 vol %, it became three times or higher compared with the case without the additive.

TABLE 2

| No. | Mg alloy | Additive Type | Additive Added Amount(vol %) | Number of treatment | Tensile strength (MPa) 20° C. | Tensile strength (MPa) 250° C. | Specific gravity |
|---|---|---|---|---|---|---|---|
| 2-1 | AZ31B | — | 0 | 200 | 318 | 65 | 1.78 |
| 2-2 | AZ31B | CaO | 5 | 200 | 416 | 124 | 1.86 |
| 2-3 | AZ31B | CaO | 10 | 200 | 429 | 138 | 1.92 |
| 2-4 | AZ61B | — | 0 | 200 | 354 | 67 | 1.78 |
| 2-5 | AZ61B | CaO | 5 | 200 | 427 | 115 | 1.87 |
| 2-6 | AZ61B | CaO | 10 | 200 | 501 | 144 | 1.94 |
| 2-7 | 97 wt % AZ31B + 3 wt % Al | CaO | 10 | 200 | 475 | 146 | 1.98 |
| 2-8 | AZ61B | $CaO/La_2O_3$ | 5/5 | 200 | 467 | 175 | 2.09 |

Table 2 shows the results for the extruded material obtained when the ASTM standard AZ31B or AZ61B was used as the Al-containing magnesium alloy. As seen from Table 2, the effect of the additive was observed for various Al-containing magnesium alloys.

When a blend of AZ31B alloy chips and Al powder (AZ31B:Al=97:3 (mass ratio)) was used as the starting Al-containing magnesium alloy raw material (Test Example 2-7), the obtained results were about the same as the case in which AZ61B was used (Test Example 2-6). In the extruded material of Test Example 2-6, Al powder peaks were missing in the X-ray diffraction pattern.

Test Example 2-8, wherein the secondary additive $La_2O_3$ was used, is improved in the tensile strength at 250° C., compared with Test Examples 2-5 to 2-7, wherein the additive was CaO only; thus it is understood that the secondary additive has a special effect.

In addition, as shown in the following Table 3, the improvement of other mechanical properties was also possible with the use of the additive.

Thus, the addition effect is observed from about 1 vol % of the additive in the mixture. From the standpoint of strength, however, it is preferably 5 vol % or higher and more preferably 7 vol % or higher.

On the other hand, even when the additive is added in excess, the effect corresponding to the added amount may not be obtained. In addition, the specific gravity of the magnesium-based composite material becomes higher with an increase in the amount of the additive. Therefore, the addition in excess is not desirable from the standpoint of the light weight properties of magnesium alloys. Accordingly, the amount of the additive in the mixture is preferably 20 vol % or less, and more preferably 15 vol % or less.

In the extruded materials obtained with the use of the additive, the formation of $Al_2Ca$ was observed in all of them. In the electron microscope observation, the presence of dispersed fine particles was observed on the boundaries of size-refined crystal grains of Mg alloy.

TABLE 3

| No. | Mg alloy | Additive Type | Additive Added Amount(vol %) | Number of treatment | Hardness Hv | Young's modulus (Gpa) | Linear expansion coefficient ($10^{-5}$/K) | Specific gravity |
|---|---|---|---|---|---|---|---|---|
| 1-1 | AM60B | — | 0 | 200 | 78.6 | 45 | 2.68 | 1.78 |
| 1-3 | AM60B | CaO | 5 | 200 | 108 | 49.7 | 2.53 | 1.88 |
| 1-4 | AM60B | CaO | 10 | 200 | 130 | 53.6 | 2.38 | 1.95 |
| 1-5 | AM60B | CaO | 15 | 200 | 139 | 58.8 | 2.29 | 2.03 |
| 2-1 | AZ31B | — | 0 | 200 | 65 | 44.3 | 2.67 | 1.78 |
| 2-2 | AZ31B | Cao | 5 | 200 | 99 | 48.6 | 2.55 | 1.86 |
| 2-4 | AZ61B | — | 0 | 200 | 80 | — | — | 1.78 |
| 2-5 | AZ61B | CaO | 5 | 200 | 107 | — | — | 1.87 |
| 2-6 | AZ61B | CaO | 10 | 200 | 127 | — | — | 1.94 |
| 2-7 | 97 wt % AZ31B + 3 wt % Al | CaO | 10 | 200 | 124 | — | — | 1.98 |

TABLE 4

| No. | Mg alloy | Additive Type | Additive Added Amount (vol %) | Number of treatment | 0.2% Proof stress (20° C.) |
|---|---|---|---|---|---|
| 2-4 | AZ61B | — | 0 | 200 | 262 |
| 2-6 | 97 wt % AZ31B + 3 wt % CaO | CaO | 10 | 200 | 449 |
| 2-7 | AZ61B | $CaO/La_2O_3$ | 5/5 | 200 | 445 |

Figure 5:
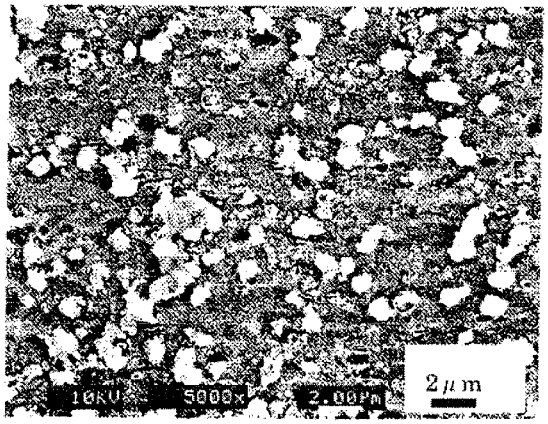
FIG. 5 shows an SEM micrograph (5000 times) of the extruded material obtained from 10 vol % CaO-added AM60B.

As a representative example, an SEM micrograph of the metallic structure for the extruded material that was obtained in Test Example 1-4 is shown in FIG. 5. As seen from FIG. 5, the crystal grains of the Mg alloy are refined to 5 μm or less, and fine particles of 2 μm or less are dispersed on the grain boundaries.

Figure 6:
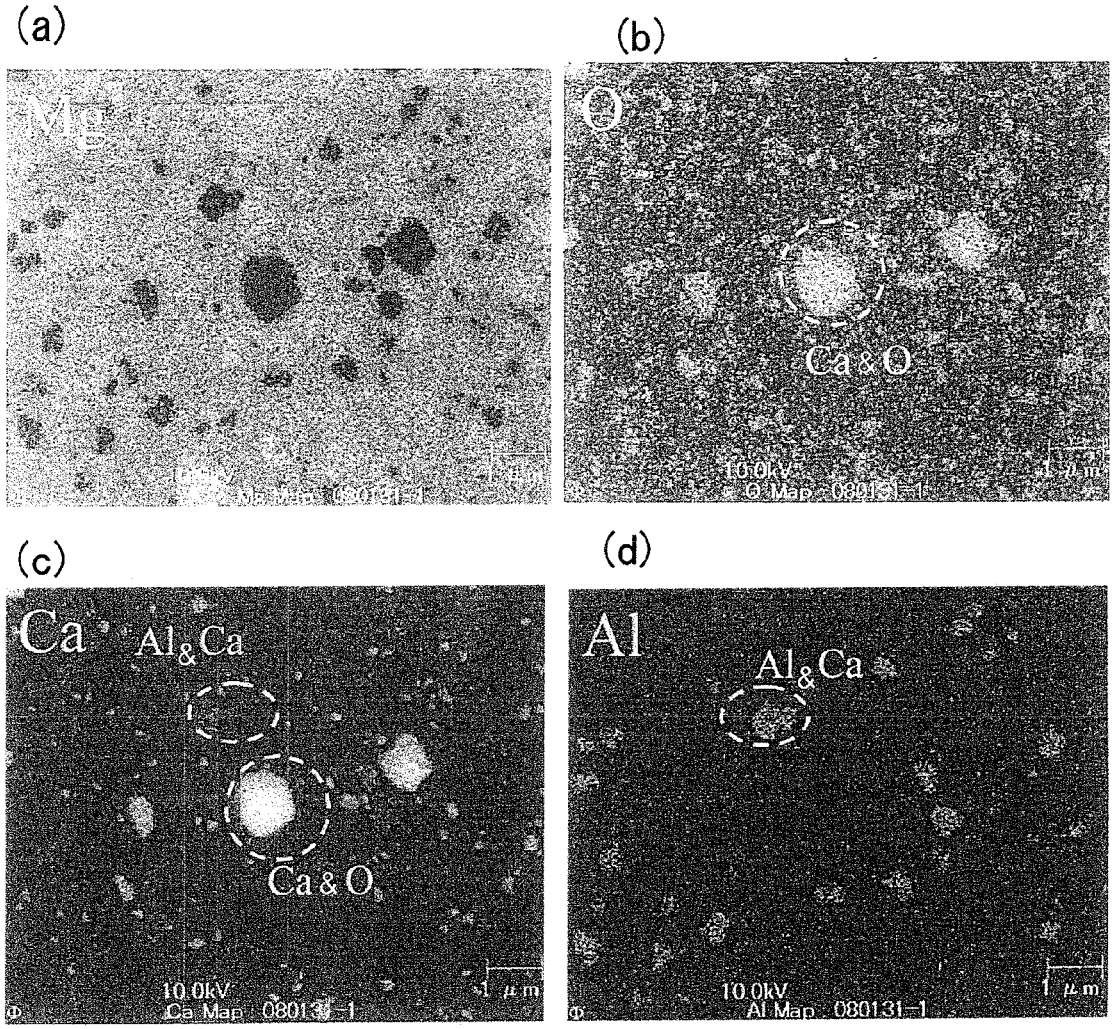
FIG. 6 shows AES images (10000 times) of the extruded material obtained from 15 vol % CaO-added AM60B.

As a result of further investigation by Auger electron spectroscopy (AES), it was confirmed that $Al_2Ca$ particles and CaO particles were dispersed. As a representative example, the AES analysis results (10000 times) of the extruded material obtained in Test Example 1-5 is shown in FIG. 6.

Test Example 2

Formation of $Al_2Ca$

Figure 7:
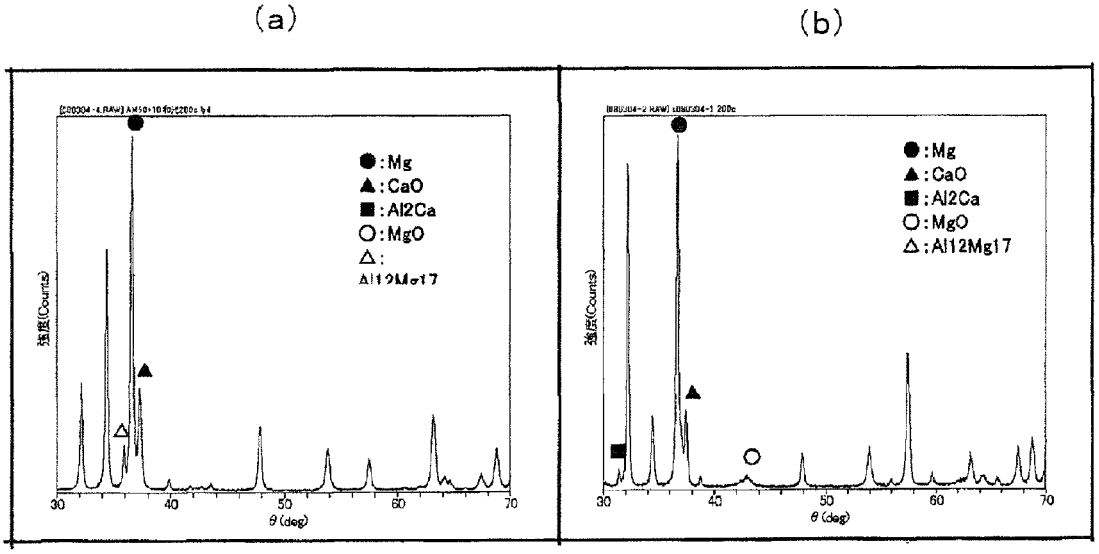
FIG. 7 shows X-ray diffraction patterns for the (a) green compact (billet, number of grain refinement treatment: 200 times) obtained from 10 vol % CaO-added AM60B alloy and the (b) extruded material.

FIG. 7 shows X-ray diffraction results for the (a) green compact (billet) and (b) extruded material (round bar) in Test Example 1-4 wherein CaO was used as the additive. In FIG. 7, the CaO peak was observed for both billet and extruded material. However, the $Al_2Ca$ peak was not observed for the billet and observed only for the extruded material.

Figure 8:
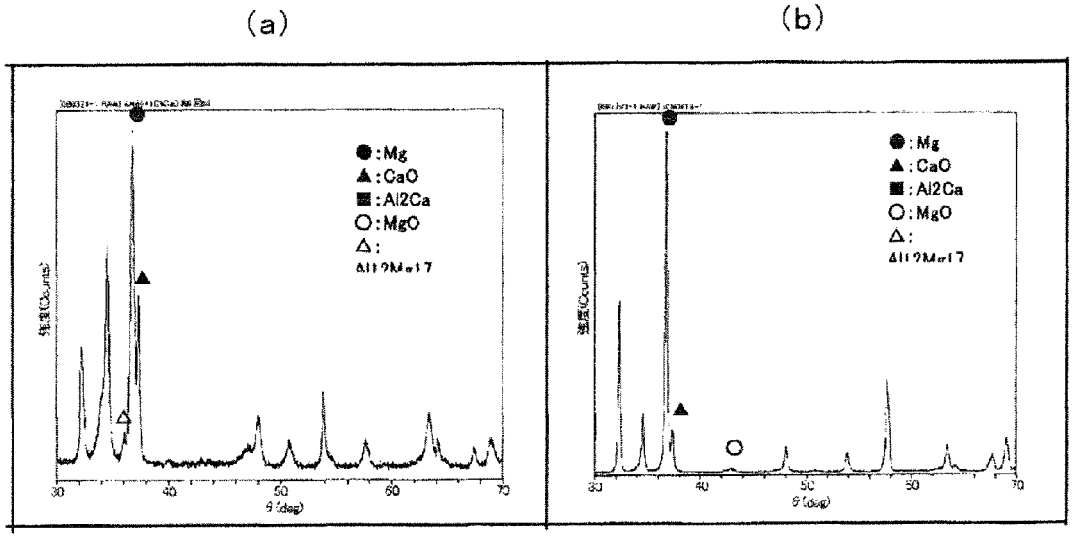
FIG. 8 shows X-ray diffraction patterns for the (a) green compact (billet, number of grain refinement treatment: 0 times) obtained from CaO-free AM60B and the (b) extruded material.

FIG. 8 shows X-ray diffraction results when the number of grain refinement treatment was 0 times (simple compression only) in Test Example 1-4. In FIG. 8, the CaO peak was observed; however, no $Al_2Ca$ peak was observed for both the (a) billet and (b) extruded material.

In both FIGS. 7 and 8, the MgO peak was not observed for the (a) billet, and the MgO peak was observed only for the (b) extruded material.

Thus, it was speculated that: the formation of $Al_2Ca$ contributes to the tensile strength, in particular, to the tensile strength at high temperature; it is important, for the formation of $Al_2Ca$, that an Al-containing magnesium alloy and the additive are sufficiently refined and activated by grain refinement treatment; and such a mixture is thermochemically reacted during plastic working to form $Al_2Ca$.

As shown in FIGS. 7 and 8, the peak of the β phase ($Al_{12}Mg_{17}$) was observed in the (a) billet: however, in the (b) extruded material, this peak was missing. It was reported that the β phase blocks the improvement of the strength characteristics at high temperature (Japanese Unexamined Patent Publication No. 2007-197796). Thus, the disappearance of the β phase is considered to contribute also to the strength characteristics at high temperature of the magnesium-based composite material of the present invention.

In order to further investigate the formation of $Al_2Ca$, the CaO-containing billet obtained by grain refinement treatment and the CaO-containing billet obtained by only simple compression without grain refinement treatment were only heat-treated under Ar atmosphere, and the formation of $Al_2Ca$ was investigated. The heat treatment was carried out by increasing the temperature of the billet to a specified temperature in a muffle furnace under Ar atmosphere and then maintaining there for a specified time.

Figure 9:
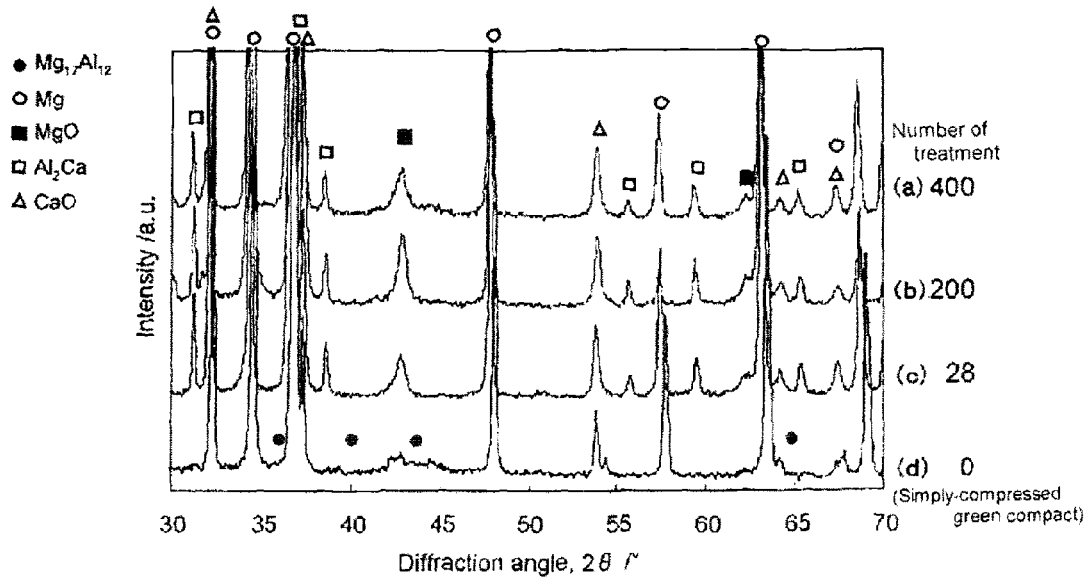
FIG. 9 shows X-ray diffraction patterns after the billets obtained, from a mixture of AZ61 with added 10 vol % CaO, by the grain refinement treatment of (a) 400 times, (b) 200 times, (c) 28 times, or (d) 0 times was treated at 500° C. in Ar atmosphere for 1 hour.

As a representative example, X-ray diffraction results are shown in FIG. 9 for the billets obtained from the mixture of AZ61 with added 10 vol % CaO by the grain refinement treatment of (a) 400 times, (b) 200 times, (c) 28 times, or (d) 0 times followed by the heat treatment by maintaining at 500° C. for 1 hour under Ar atmosphere.

As seen from FIG. 9, in the CaO-containing billet obtained by only simple compression without grain refinement treatment, the formation of $Al_2Ca$ was not observed even with heat treatment. However, in the CaO-containing billet obtained by grain refinement treatment, the formation of $Al_2Ca$ was observed even with heat treatment only.

Accordingly, for the $Al_2Ca$ formation by a solid-phase reaction, the grain refinement treatment of an Al-containing magnesium alloy and the additive and the heating at less than the melting point (namely, thermochemical reaction) are considered to be necessary.

According to the investigation of the present inventors, the heating temperature depends upon the kinds of raw materials. The heating temperature is preferably 350° C. or higher, and more preferably 400° C. or higher. If the heating temperature is too low, $Al_2Ca$ may not be sufficiently formed within a realistic heating time.

Figure 10:
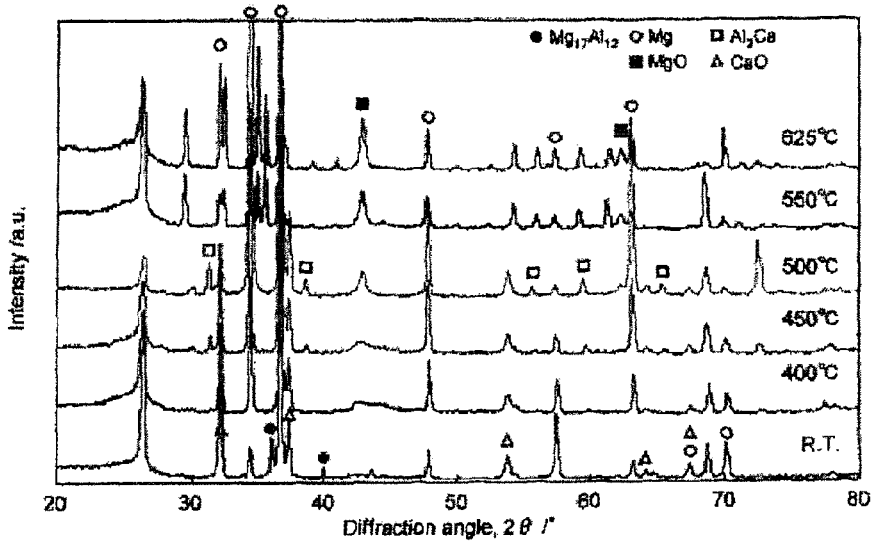
FIG. 10 shows X-ray diffraction patterns after the billet obtained from a mixture of AZ61 with added 10 vol % CaO (number of grain refinement treatment: 200 times) was treated at 400° C. to 625° C. under Ar atmosphere for 4 hours.

As a representative example, X-ray diffraction patterns are shown in FIG. 10 for the billet, obtained from the mixture of AZ61 with added 10 vol % CaO (number of grain refinement treatment: 200 times), after the thermochemical reaction treatment by maintaining it at 400° C. to 625° C. under Ar atmosphere for 4 hours. As seen from FIG. 10, the slight formation of $Al_2Ca$ was observed at 400° C., and the $Al_2Ca$ peaks have a trend to become larger with the increase in temperature.

On the other hand, if the heating temperature is too high, the $Al_2Ca$ peaks may become rather small. In FIG. 10, the $Al_2Ca$ peaks at 550° C. are small. The reason is not clear; however, other reactions might be taking place. The excess heating also tends to decrease the strength at ordinary temperature because of the coarsening of Mg alloy crystal grains. Accordingly, the heating temperature is preferably 550° C. or lower, and more preferably 500° C. or lower though it depends upon the kinds of raw materials.

Figure 11:
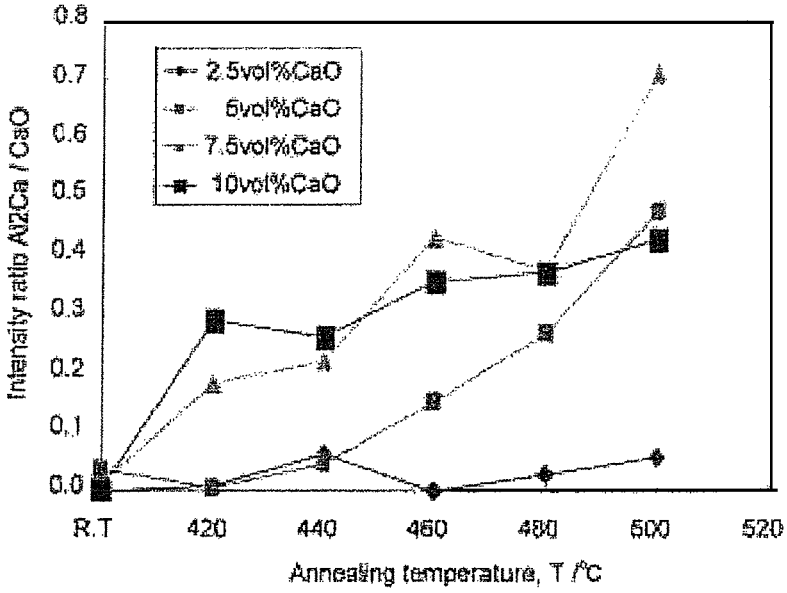
FIG. 11 shows a relationship between the peak intensity ratio of $Al_2Ca$)(38.55°/CaO) (53.9° and the heating temperature, said ratio being determined from the X-ray diffraction patterns after the billet obtained from a mixture of AZ61 with added CaO (number of grain refinement treatment: 200 times) was treated heat-treated under Ar atmosphere for 4 hours.

FIG. 11 shows a relationship between the peak intensity ratio of $Al_2Ca$ (38.55°)/CaO (53.9°) and the heating temperature. The intensity ratio was obtained from the X-ray diffraction patterns for the billet, obtained from the mixture of AZ61 with added CaO (number of grain refinement treatment: 200 times), after the thermochemical reaction treatment by maintaining it at 420 to 500° C. under Ar atmosphere for 4 hours. The $Al_2Ca$/CaO peak ratio can be evaluated as the conversion rate from CaO to $Al_2Ca$.

As seen from FIG. 11, the conversion rate from CaO to $Al_2Ca$ was observed to increase, on the whole, with an increase in the heating temperature.

When the amount of added CaO was small (2.5 vol %), the conversion rate to $Al_2Ca$ was very small even at high temperature. The theoretical amount of Ca necessary to convert the entire Al in AZ61 to $Al_2Ca$ corresponds to about 3.1 vol % of CaO; thus the above is considered to be due to the small amount of CaO. In addition, a trend was observed that the larger the amount of CaO, the easier the formation of $Al_2Ca$ even at low temperature.

Accordingly, from the standpoint of the conversion (reactivity) to $Al_2Ca$, the amount of CaO used is adjusted so that Ca contained in the CaO, with respect to Al, is preferably 0.5 times mole equivalent or higher, more preferably 0.8 times mole equivalent or higher, and most preferably 1 time mole equivalent or higher.

Test Example 3

Dispersed Particles and the Tensile Strength

Figure 12:
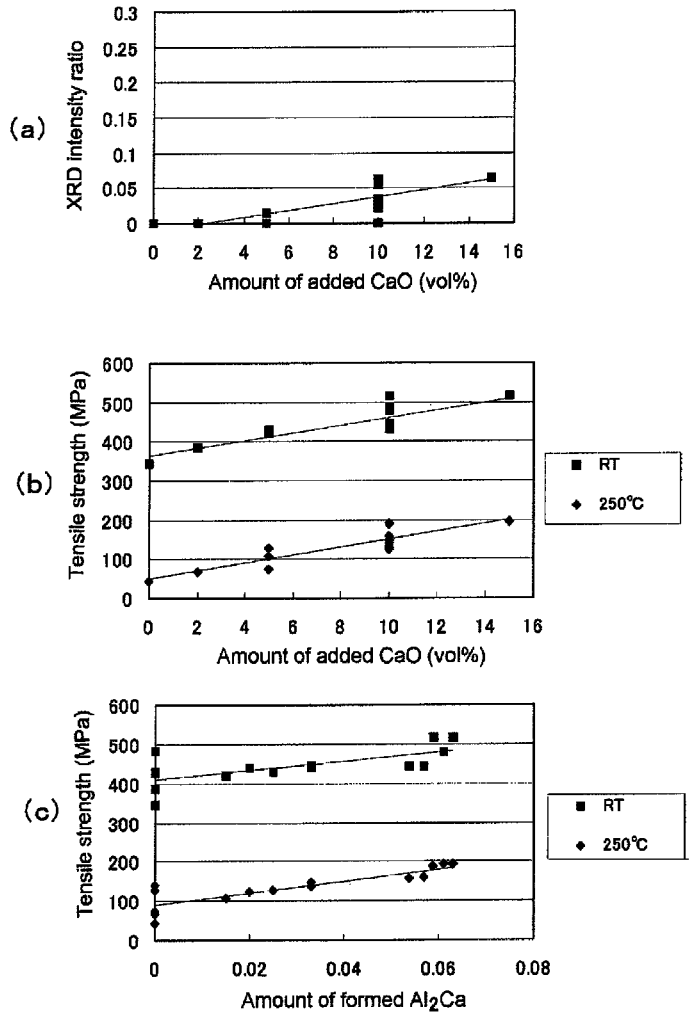
FIG. 12 shows the respective relationships, for the extruded material obtained from the CaO-added AM60B, of (a) the amount of formed $Al_2Ca$ versus the amount of added CaO, (b) the tensile strength at ordinary temperature and 250° C. versus the amount of added CaO, and (c) the tensile strength at ordinary temperature and 250° C. versus the amount of formed $Al_2Ca$.

FIG. 12 is for the extruded material obtained with the use of AM60B+CaO, as the starting raw materials, and shows the following respective relationships:

(a) the amount of formed $Al_2Ca$ with respect to the amount of added CaO, (b) the tensile strength at ordinary temperature and that at 250° C. with respect to the amount of added CaO, and (c) the tensile strength at ordinary temperature and that at 250° C. with respect to the amount of formed $Al_2Ca$.

As the amount of formed $Al_2Ca$, the peak intensity ratio of $Al_2Ca$ (31.3°)/Mg (36.6°) in XRD was used.

As seen in FIG. 12(*a*) to FIG. 12(*c*), the amount of formed $Al_2Ca$ in the extruded material increased with an increase in the amount of the additive. In concert with it, the tensile strength at ordinary temperature and that at 250° C. have an increasing trend.

The following Table 5 is for the extruded material obtained from AZ91+CaO as the starting raw material. The amount of formed $Al_2Ca$ (peak intensity ratio of $Al_2Ca$ (31.3°)/Mg (36.6°)) is about the same for both Test Example 3-2 and Test Example 3-3. However, the residual amount of CaO (peak intensity ratio of CaO (37.3°)/Mg (36.6°)) in Test Example 3-3 is about 2 times that of Test Example 3-2. Because the tensile strength of Test Example 3-3 is higher than that of Test Example 3-2, the presence of CaO particles is also considered to contribute to the tensile strength.

TABLE 5

| Additive | | | XRD peak intensity ratio | | Tensile strength (MPa) | |
|---|---|---|---|---|---|---|
| No. | Type | Added Amount (vol %) | $Al_2Ca$/Mg | CaO/Mg | 20° C. | 250° C. |
| 3-1 | CaO | 5 | 0.054 | 0.080 | 404 | 108 |
| 3-2 | CaO | 10 | 0.110 | 0.136 | 467 | 170 |
| 3-3 | CaO | 15 | 0.117 | 0.313 | 512 | 192 |

Test Example 4

Sintering of Green Compact

The green compact (billet) obtained by grain refinement treatment (number of treatment: 200 times) is treated by SPS (spark plasma sintering) at a sintering temperature of 480 to 550° C. X-ray diffraction was performed for the obtained SPS material. SPS conditions were as follows.

(SPS Conditions)

Equipment: DR. SINTER SPS-1030S, manufactured by Sumitomo Coal Mining Co., Ltd.

(1) A green compact billet (diameter of 35 mm×80 mm) is packed in a carbon container (inner diameter of 36 mm×height of 100 mm), and the top and bottom are covered with lids.

(2) The container is placed in the SPS equipment, evacuated, and then heated to a specified temperature while maintaining a pressure of 10 MPa.

(3) While maintaining a pressure of 30 MPa, the application of heat was maintained for 1 hour.

(4) When the container cooled to 150° C. or lower, the vacuum is released. The container is taken out from the SPS equipment and cooled in air, and then the SPS material was taken out from the container.

In Table 6, X-ray diffraction results are shown for the SPS materials obtained from the starting raw materials AZ61B+CaO. In the green compact before SPS treatment, the formation of $Al_2Ca$ was not observed. On the other hand, as shown in Table 6, $Al_2Ca$ was formed by sintering the green compact. In the SEM observation of the SPS materials, fine dispersed particles of $Al_2Ca$ were observed. In Test Example 4-2, fine dispersed particles of CaO were also observed.

In addition, the tensile strength of extruded material obtained by extruding the SPS material (extrusion temperature: 450° C., extrusion diameter: 7 mm, and extrusion ratio: 28) was measured, and a high tensile strength was obtained at both 20° C. and 250° C.

TABLE 6

| | | Additive | | | XRD peak intensity ratio of SPS material | | Tensile strength of extruded material (MPa) | |
|---|---|---|---|---|---|---|---|---|
| No. | Mg alloy | Type | Added Amount (vol %) | Number of treatment | $Al_2Ca$/Mg | CaO/Mg | 20° C. | 250° C. |
| 4-1* | AZ61 | CaO | 2.5 | 200 | 0.032 | — | 383 | 107 |
| 4-2* | AZ61 | CaO | 7.5 | 200 | 0.042 | 0.062 | 442 | 140 |

*SPS temperature: 550° C. (Test Example 4-1), 480° C. (Test Example 4-2)

As described above, in the magnesium-based composite material of the present invention, $Al_2Ca$ formed by a solid-phase reaction, and further the additive CaO, are very finely dispersed in the Al-containing magnesium alloy of which crystal grains are refined. Because of these dispersed particles, the strength characteristics, heat resistance, etc. are markedly improved. Such a magnesium-based composite material can be typically obtained by refining, in grain size, a mixture of an Al-containing magnesium alloy and calcium oxide while maintaining the solid phase state to prepare a grain-refined mixture and by reacting thermochemically this mixture at less than the melting point. More desirably, plastic working is carried out during or after the thermochemical reaction. In addition, according to the present invention, a magnesium-based composite material without β phase can be obtained.

What is claimed is:

1. A method for producing an $Al_2Ca$-containing magnesium-based composite material comprising carrying out a solid-phase reaction of an aluminum-containing magnesium alloy and an additive, wherein said additive is calcium oxide, and said composite material contains $Al_2Ca$ formed in the solid-phase reaction.

2. The method for producing the $Al_2Ca$-containing magnesium-based composite material of claim 1, wherein the aluminum-containing magnesium alloy is a magnesium alloy containing at least one of alloyed aluminum and mixed aluminum.

3. The method for producing the $Al_2Ca$-containing magnesium-based composite material of claim 1, wherein CaO, in combination with $Al_2Ca$, is dispersed in the magnesium-based composite material.

4. The method for producing the $Al_2Ca$-containing magnesium-based composite material of claim 1, said solid-phase reaction comprising: mechanically refining, in grain size, a mixture of the aluminum-containing magnesium alloy and the additive while maintaining a solid phase state to prepare a grain-refined mixture, and carrying out a thermochemical reaction, at less than the melting point, of the grain-refined mixture or its green compact.

5. The method for producing the $Al_2Ca$-containing magnesium-based composite material of claim 4, wherein the $Al_2Ca$ is formed by the thermochemical reaction, by heating to 350 to 550° C., of the grain-refined mixture or its green compact.

6. The method for producing the $Al_2Ca$-containing magnesium-based composite material of claim 4, wherein the thermochemical reaction is sintering.

7. The method for producing the $Al_2Ca$-containing magnesium-based composite material of claim 4, wherein plastic working is carried out after the thermochemical reaction.

8. The method for producing the $Al_2Ca$-containing magnesium-based composite material of claim 4, wherein plastic working is carried out during the thermochemical reaction.

9. The method for producing the $Al_2Ca$-containing magnesium based composite material of claim 8, wherein the composite metal is obtained by mechanically refining, in grain size, the mixture of the aluminum-containing magnesium alloy and the additive while maintaining the solid phase state to prepare the grain-refined mixture, and by carrying out the plastic working, at less than the melting point, of the grain-refined mixture or its green compact.

10. The method for producing the $Al_2Ca$-containing magnesium-based composite material of claim 9, wherein the plastic working is extrusion.

11. The method for producing the $Al_2Ca$-containing magnesium-based composite material of claim 10, wherein the extrusion temperature is 350 to 550° C.

12. The method for producing the $Al_2Ca$-containing magnesium-based composite material of claim 4, wherein the amount of the additive in the mixture of the aluminum-containing magnesium alloy and the additive, which are to be refined in grain size, is 1 to 20% by volume.

13. The method for producing the $Al_2Ca$-containing magnesium-based composite material of claim 4, wherein the amount of the additive is adjusted so that the mole ratio of Ca/Al in the mixture of the aluminum-containing magnesium alloy and the additive, which are to be refined in grain size, is 0.5 or higher.

14. The method for producing the $Al_2Ca$-containing magnesium-based composite material of claim 1, wherein the maximum size of dispersed $Al_2Ca$ particles in the composite material is 5 microns or less, and when dispersed CaO particles in the composite material are present, the maximum size of dispersed CaO particles is 5 microns or less.

15. The method for producing the $Al_2Ca$-containing magnesium-based composite material of claim 1, wherein the maximum size of the magnesium alloy crystal grain in the composite material is 20 microns or less.

16. The method for producing the $Al_2Ca$-containing magnesium-based composite material of claim 1, wherein $Al_{12}Mg_{17}$ is not contained in the composite material.

17. The method for producing the $Al_2Ca$-containing magnesium-based composite material of claim 1, wherein the composite metal has the tensile strength of 400 MPa or higher at 20° C. and the tensile strength of 100 MPa or higher at 250° C.

18. A method for producing a material for thermochemical reaction or plastic working, comprising mechanically refining, in grain size, a mixture of an aluminum-containing magnesium alloy and an additive while maintaining a solid phase state to prepare a grain-refined mixture, wherein said grain-refined mixture or its green compact is the material and said additive is calcium oxide, wherein the material is heated at less than the melting point to form $Al_2Ca$.

19. The method for producing the material for thermochemical reaction or plastic working of claim 18, wherein the aluminum-containing magnesium alloy is a magnesium alloy containing at least one of alloyed aluminum and mixed aluminum.

20. The method for producing the material for thermochemical reaction or plastic working of claim 18, wherein the heating temperature is 350 to 550° C.

21. The method for producing the material for thermochemical reaction or plastic working of claim 18, wherein the amount of the additive in the mixture of the aluminum-containing magnesium alloy and the additive, which are to be refined in grain size, is 1 to 20% by volume.

22. The method for producing the material for thermochemical reaction or plastic working of claim 1, wherein the amount of the additive is adjusted so that the mole ratio of Ca/Al in the mixture of the aluminum-containing magnesium alloy and the additive, which are to be refined in grain size, is 0.5 or higher.

23. The method for producing the material for thermochemical reaction of claim 18, wherein the thermochemical reaction is sintering.

24. The method for producing the material for plastic working of claim 18, wherein the plastic working is extrusion.

* * * * *